US005431025A

United States Patent [19]

Oltman et al.

[11] Patent Number: 5,431,025

[45] Date of Patent: Jul. 11, 1995

[54] APPARATUS AND METHOD OF OIL CHARGE LOSS PROTECTION FOR COMPRESSORS

[75] Inventors: Robert L. Oltman, Stoddard; Michael D. Carey, Holmen, both of Wis.

[73] Assignee: American Standard Inc., Piscataway, N.J.

[21] Appl. No.: 266,539

[22] Filed: Jun. 27, 1994

Related U.S. Application Data

[62] Division of Ser. No. 96,801, Jul. 23, 1993, Pat. No. 5,347,821.

[51] Int. Cl.[6] ..... F25B 43/02

[52] U.S. Cl. ..... 62/84; 62/129; 62/193

[58] Field of Search ..... 62/126, 129, 192, 193, 62/470, 228.1, 84; 417/13, 32, 281

[56] References Cited

U.S. PATENT DOCUMENTS

| | | | |
|---|---|---|---|
| 3,232,519 | 2/1966 | Long | 230/17 |
| 3,805,547 | 4/1974 | Eber | 62/505 |
| 3,820,350 | 6/1974 | Brandin et al. | 62/193 |
| 4,090,371 | 5/1978 | Keane | 62/193 X |
| 4,227,862 | 10/1980 | Andrew et al. | 417/13 X |
| 4,583,919 | 4/1986 | Keith | 417/228 |
| 4,643,654 | 2/1987 | Rinder | 718/201 |
| 4,730,988 | 3/1988 | Ma | 417/313 |
| 4,730,995 | 3/1988 | Dewhirst | 418/1 |
| 4,888,957 | 12/1989 | Chmielewski | 62/84 |
| 5,016,447 | 5/1991 | Lane et al. | 62/470 |
| 5,027,608 | 7/1991 | Rentmeester et al. | 62/115 |
| 5,029,448 | 7/1991 | Carey | 62/84 |
| 5,062,277 | 11/1991 | Heitmann et al. | 62/193 |
| 5,067,560 | 11/1991 | Carey et al. | 165/124 |
| 5,199,858 | 4/1993 | Tsuboi et al. | 417/362 |
| 5,201,648 | 4/1993 | Lakowske | 418/201 |
| 5,203,685 | 4/1993 | Andersen et al. | 418/1 |
| 5,212,964 | 5/1993 | Utter et al. | 62/498 |
| 5,295,362 | 3/1994 | Shaw et al. | 62/193 |

*Primary Examiner*—Harry B. Tanner

*Attorney, Agent, or Firm*—William J. Beres; William O'Driscoll; Peter D. Ferguson

[57] ABSTRACT

A method of compressor over temperature protection. The method comprises the steps of monitoring the temperature of oil entering a compressor, determining an oil temperature differential between the entering and exiting oil temperatures, comparing the oil temperature differential to first and second predetermined limits, terminating compressor operation if the first limit is exceeded by the oil temperature differential, and terminating compressor operation if the second temperature limit is exceeded by the oil temperature differential for longer than a first time period.

3 Claims, 3 Drawing Sheets

APPARATUS AND METHOD OF OIL CHARGE LOSS PROTECTION FOR COMPRESSORS

This application is a division of application Ser. No. 08/096,801, filed Jul. 23, 1993, now U.S. Pat. No. 5,347,821.

TECHNICAL FIELD

This invention relates generally to compressors utilized in refrigeration systems. More particularly, the present invention relates to a method of detecting a loss of oil charge in such compressors resulting from leakage of oil from the system or from reduced oil flow due to a restriction in the lubricating lines. The present invention also detects inadequate oil cooling by the oil cooler.

BACKGROUND OF THE INVENTION

Conventional air conditioning systems utilize a compressor to compress refrigerant gas, a condenser to remove some of the heat of the refrigerant gas and to condense the refrigerant to a high pressure liquid, and an evaporator that uses the refrigerant to cool a supply of water that in turn cools the space that is being air conditioned. Air conditioners utilize a number of different designs of compressors depending on the application that the air conditioning system is being used for. Although applicable to all lubricated air conditioning compressors, the present invention is described as applied to a screw compressor.

A screw compressor is a positive-displacement compressor that uses a first rotor driving a second rotor (termed the driven rotor and the slave rotor) to provide the compression cycle. The two rotors each have cooperating helical lobes that are interleaved with each other. Since the driven rotor drives the slave rotor by means of the interleaved lobes of the two rotors, the two rotors are necessarily counter-rotating. The design uses injected oil to cool the compressed refrigerant gas, to seal the volume created between the rotors in which the refrigerant is compressed and to lubricate the rotor bearings. A comparatively large oil capacity, as much as a flow rate of ten gallons (37.854 liters) per minute in some applications, is required to perform these functions. This large quantity of oil is injected directly into the lobe area as the refrigerant is being compressed. The oil and the refrigerant in this way become thoroughly intermixed.

A typical screw compressor system consists of the compressor, motor, oil/gas separator and reservoir. The screw compressor may also include an oil cooler with a filter. The motor drives the driven rotor either directly or through a gearset. Direct drive is preferable to avoid the mechanical losses that result from the gearset. Rotational speeds of the compressor are on the order of 3600 RPM. Since the oil is injected directly into the rotor area of the compressor, the oil and the refrigerant gas mix. A single output line transports the mixed compressed refrigerant and hot oil to an oil/gas separator. The oil separator separates the oil and the refrigerant and stores the oil temporarily in the reservoir prior to sending the oil to the oil cooler. The oil cooler cools the oil to a temperature at which the oil has good lubricating properties and can again cool the compressor. The cooled oil is then pumped back to the compressor where the lubricating and cooling cycle of the oil begins anew.

The compression process starts with the rotors interleaved at the inlet port of the compressor. As the rotors turn, the lobes are separated, causing a reduction in pressure, drawing the refrigerant in through the inlet port. The refrigerant fills the volume defined between the lobe of the driven rotor and the lobe of the slave rotor. The intake cycle is completed when the lobes have turned far enough to be sealed off from the inlet port. As the lobes continue to turn, the volume of the space defined by the lobes between the meshing point of the rotors is continuously decreased. By continuously decreasing the volume as the helical rotors rotate, the refrigerant that was drawn through the inlet into the volume between the lobes is compressed. Ultimately, the interleaved lobes open to the discharge port, allowing the compressed refrigerant and the entrained oil to flow out of the compressor through a common line to the oil/gas separator.

The ratio of the volume of gas trapped after the intake cycle to the volume of gas trapped just before the lobe opens to the discharge port is known as the built-in volume ratio. With the injected oil performing a majority of the cooling and with very low pressure differential across each lobe, the screw compressor can reach built-in volume ratios as high as 20:1 when operating at full capacity. Additionally, throttling controls are typically included in order to permit the screw compressor to operate over a wide range of capacities depending on the amount air conditioning cooling required at any given time. A typical throttle comprises a sliding valve that slides in the valley formed between the interleaved rotors. The valve discharges the compressed refrigerant from the compressor before the refrigerant has undergone the full extent of compression possible.

As noted above, the refrigerant gas temperature rises dramatically due to the heat generated by the refrigerant gas as the gas undergoes compression. The injected oil cools the refrigerant gas and the compressor. By keeping the compressor relatively cool, the oil enables the compressor to attain high volume ratios, thereby increasing the efficiency of the screw compressor. The discharge temperature of a screw compressor seldom exceeds 200° F. (93° C.), with the normal temperatures running around 160° F. to 180° F. (71° C. to 82° C.). The oil flow through the compressor removes up to forty percent of the heat generated by the compression of the refrigerant gas.

The oil also forms a film between the two rotors to allow the drive rotor to turn the driven rotor without metal-to-metal contact. Effectively, a thin film of oil resides between the lobes of the two rotors and transmits the driving force of the driven rotor to the slave rotor without the driven rotor actually coming in contact with the slave rotor. This greatly increases the life cycle of the compressor by reducing wear.

It is imperative that the oil injected directly into the refrigerant gas stream during the compression cycle be separated from the refrigerant after compression is complete. Oil/gas separators are normally designed to accomplish such separation by mechanical means that exploit the fact that the liquid oil is heavier than the gaseous refrigerant. The oil/gas separator also temporarily stores the oil prior to conveying the oil to the oil cooler before sending the oil back the compressor. A reservoir is formed at the bottom of the oil separator to hold the oil.

A major portion of the heat of compression generated in the compression of the refrigerant gas is retained by the liquid oil. The oil must accordingly be cooled prior to recirculation to the compressor. The cooling of the oil also improves the lubrication properties of the oil and extends the useful life of the oil. The oil cooler is a heat exchanger in which the heat of the hot oil is rejected to a cooling medium, such as water, ethylene glycol, or air. The cooling capacity of the oil cooler is matched to the rest of the screw compressor so that the oil is returned to the compressor at a desired temperature.

Loss of the oil charge in the compressor is a serious problem since, as indicated, so much of the operation of the compressor is dependent on the continued flow of oil. An operating screw compressor will effectively destroy itself within several minutes of operation after an oil loss occurrence. It is, therefore, critical to be able to detect such a loss and to shut the compressor down before the loss causes catastrophic damage to the compressor. For purposes of this invention, an oil loss is defined as at least one of the following conditions: (1) loss of oil due to leakage in the system, (2) inadequate oil flow due to a restriction in the lubrication lines caused, for example, by a blockage, clogged filter or a malfunctioning valve, and (3) inadequate oil cooling caused by plugged condenser coil fan malfunction or the like.

A number of methods have been put forward in order to ensure that the compressor has an adequate oil charge. U.S. Pat. No. 3,232,519 proposes utilizing a fairly large number of sensors in the compressor to detect abnormal temperatures and abnormal temperature differentials. The sensed values are compared with a series of setpoints that are fixed in the control system. Such indications are then assumed to be indicative of a particular problem in the oil delivery system. Unless a system always operates under exactly the same conditions, however, the setpoints must necessarily be a compromise to capture as wide a range of operating conditions as possible without being so wide as to be meaningless for the extreme operating conditions. A more useful standard would be one that is variable with the operating conditions and is therefore meaningful for all operating conditions.

U.S. Pat. No. 4,583,919 proposes utilizing a sensor of the temperature of the oil at the inlet to the compressor to determine if additional oil is needed. The temperature of the oil is compared to a setpoint and when that setpoint is exceeded, a second oil line is opened to the compressor.

U.S. Pat. No. 5,062,277 is concerned with oil loss. The '277 patent discloses the use of an oil heater to detect oil loss by sensing the temperature of the heater. The heater normally is submerged in the oil at a selected level in the oil tank. The heater uses the oil that is in the tank as a heat sink. If the temperature of the heater is sensed to have risen unduly, it is assumed that the oil has dropped below the level of the heater, since the heat sink is no longer available to draw the heat off of the heater.

It would be a decided advantage to have a reliable means of early detection of loss of oil charge in a screw compressor. The detector should permit timely shutdown of the screw compressor prior to the occurrence of any internal damage thereof resulting from the loss of oil. The method of detection must be effective over all operating conditions of the screw compressor and therefore should not be limited to comparison to a setpoint.

When the screw compressor package suffers a loss of oil charge, the reservoir of the oil/gas separator and the oil cooler fill with refrigerant. This refrigerant then undergoes the cooling in the oil cooler that is meant for the oil. It is this characteristic of the screw compressor package and the fact that the oil and the refrigerant have different heat transfer coefficients that make possible the oil loss detection method of the present invention.

SUMMARY OF THE INVENTION

The present invention is a method for monitoring oil charge loss for use with a refrigeration system having a screw compressor for compressing a refrigerant gas, an oil/gas separator for separating compressed refrigerant from lubricating oil, a condenser for condensing the compressed refrigerant gas, an oil cooler for cooling oil separated from the refrigerant (the refrigerant and oil both having known and differing coefficients of heat transfer), and an injection system for injecting the cooled oil into the screw compressor. The method includes the steps of:

a. determining the difference in temperatures of oil cooled in the oil cooler and refrigerant cooled in the oil cooler based on the known coefficients of heat transfer of the refrigerant and the oil and the cooling capacity of the oil cooler;
b. sensing the temperature of the liquid in the injection system;
c. sensing the temperature of the saturated refrigerant in the condenser;
d. comparing the temperature of the liquid in the injection system and the temperature of the saturated refrigerant in the condenser; and
e. generating a signal to shut down the screw compressor when the comparison of the temperature of the liquid in the injection and the temperature of the saturated refrigerant in the condenser indicates that the liquid in the oil cooler is refrigerant as distinct from oil.

The present invention also includes an oil charge loss detector system for use in accordance with the method. The loss detector includes a sensor for sensing the temperature of the liquid cooled in the oil cooler and a second sensor for sensing the saturated refrigerant temperature in the condenser. A controller compares the sensed temperatures to predetermined criteria and generates a compressor shut down command when the temperature differential of the temperature of the liquid at the oil cooler and the saturated refrigerant temperature at the condenser indicate that the liquid in the oil cooler is refrigerant.

DETAILED DESCRIPTION OF THE DRAWINGS

Figure 1:
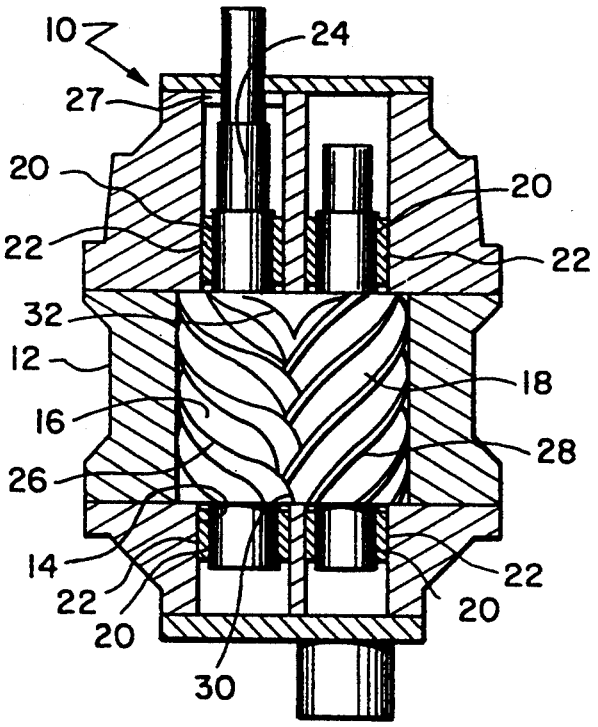
FIG. 1 is a sectional view of a twin rotor screw compressor showing the interleaved driven and slave rotors.

FIG. 1 depicts a compressor shown generally at 10. The present invention is applicable to all lubricated refrigerant compressors but is particularly described herein in terms of a screw compressor. Representative screw compressors and compressor systems are shown in U.S. Pat. No. 5,027,608 to Rentmeester et al., U.S. Pat. No. 5,201,648 to Lakowske, and U.S. Pat. No. 5,203,685 to Anderson et al., all of which are assigned to the assignee of the present invention and all of which are incorporated by reference herein.

The compressor 10 has an outer casing 12 that defines an inner housing 14. The inner housing 14 defines a cavity having close tolerances that surrounds the rotors 16, 18 and contains the pressurized refrigerant. At either end of the inner housing 14 are bearing races 20 formed into the housing 14. The inner housing 14 is constructed so as to contain the pressure generated by the compression of the refrigerant gas. The inner housing 14 additionally comprises an oil sump for collecting oil after it has been injected into the inner housing 14.

The rotors 16, 18 comprise a driven rotor 16 and a slave rotor 18. At either end of both rotors 16, 18 are bearings 22 that ride in the bearing races 20. The bearings 22 require lubrication under pressure for satisfactory operation. A representative bearing arrangement is shown in U.S. Pat. No. 4,730,995 to Dewhirst, which is assigned to the assignee of the present invention and which is incorporated herein by reference.

Figure 2:
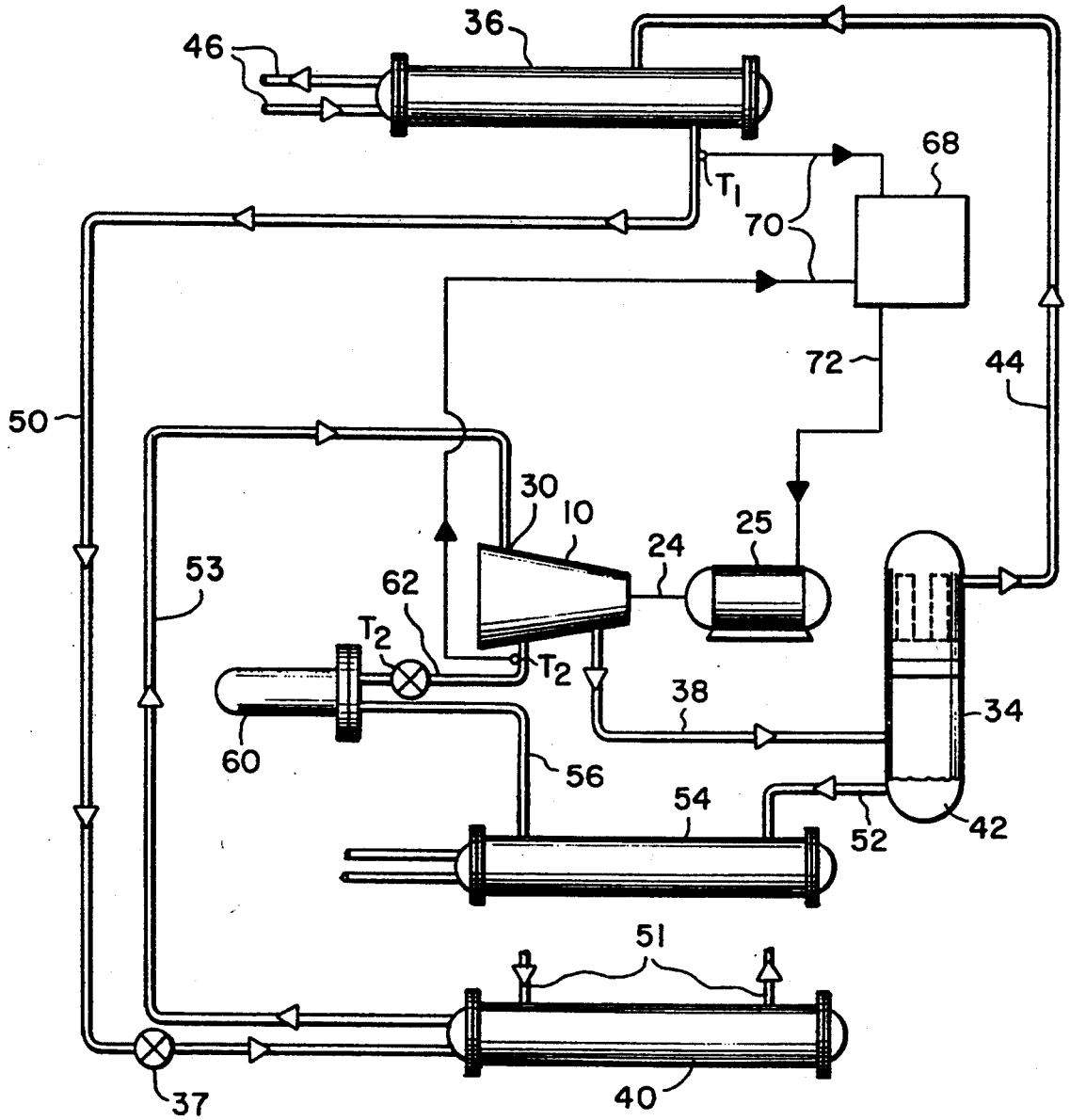
FIG. 2 is a schematic of an air conditioning system employing a compressor in conjunction with the oil charge loss protection system in accordance with the present invention.

A drive shaft 24 connects the driven rotor 16 and a motor 25, as depicted in FIG. 2. The drive shaft 24 provides rotary power from the motor 25 to drive the driven rotor 16. In an alternative embodiment, a gearset may be interposed between the motor 25 and the driven rotor 16 to provide a different rotational speed for the driven rotor 16. An oil seal 27 is provided to permit rotation of the drive shaft 24 without loss of oil from the inner housing 14. The oil seal 27 is designed to be lubricated by the oil in the inner housing 14.

The rotors 16, 18 have lobes 26, 28, respectively. The lobes 26, 28 each define a helix that comprises the compressing portion of the rotors 16, 18. The helixes that comprise lobes 26, 28 are oppositely wound such that, when the rotors 16, 18 are closely positioned side-by-side, the lobes 26, 28 interleave and rotationally mesh with one another. In this manner, when the driven rotor 16 is powered by the motor 25 and rotates in a given direction, the driven rotor 16 drives the slave rotor 18 in the opposite direction. The driven rotor 16 does not actually come in contact with the slave rotor 18, but imparts the rotational motion to the slave rotor 18 by means of a film of oil formed between the two rotors 16, 18. U.S. Pat. No. 4,643,654 to Rinder shows a representative screw rotor profile as described. This patent is assigned to the assignee of the present invention and is incorporated by reference herein.

Refrigerant gas is drawn into the screw compressor 10 at an inlet 30 and is compressed through the rotational interaction of the lobes 26, 28. The compressed refrigerant gas is then discharged at a discharge port 32. As the lobes 26, 28 interleave, the lobes 26, 28 form a series of sealed volumes between the lobes 26, 28. The actual sealing of the volumes is done by a film of oil formed between the lobes 26, 28. The two helixes are so formed that as rotation of the rotors 16, 18 progresses, a sealed volume moves from the inlet 30 toward the discharge port 32. The volume is continually reduced, thereby compressing the refrigerant gas that is trapped therein.

Referring to FIG. 2, the basic air conditioning loop is comprised of the compressor 10, an oil/gas separator 34, a condenser 36, an expansion device 37 and an evaporator 40.

The screw compressor 10 compresses refrigerant gas that is provided from an output of the evaporator 40. The output of the screw compressor 10 is a relatively hot oil and gas mixture under high pressure that is sent first to the oil/gas separator 34 via a common line 38.

The oil/gas separator 34 provides separation of the high pressure refrigerant gas from the entrained oil. This is accomplished through a number of mechanical means that exploit the fact that the oil is a relatively heavy liquid and the refrigerant is a relatively light gas. The mechanical separation means include, for example, filters, reversal of flow direction, and cyclonic action. A representative oil separator is shown in U.S. Pat. No. 5,029,448 to Carey. This patent is assigned to the assignee of the present invention and is incorporated herein by reference. As a result of separation, the entrained hot oil from the compressor 10 is collected in a reservoir 42 at the bottom of the oil/gas separator 34. The high pressure refrigerant discharge gas collects at the top of the oil/gas separator 34 and is discharged via a line 44 to the condenser 36.

The condenser 36 is a heat exchanger that extracts some of the heat from the refrigerant and condenses the hot refrigerant gas to a high pressure liquid. The condensation requires heat to be rejected from the refrigerant gas. A cooling medium in the condenser 36 is provided as illustrated by line 46, and may comprise cooled water, air or the like. U.S. Pat. No. 5,067,560 to Carey et al. illustrates a representative air cooled condenser. This patent is assigned to the assignee of the present invention and is incorporated herein by reference. The heat of condensation is exhausted to the outside air either indirectly when cooled water is used as a cooling medium or directly when air is used as a cooling medium.

The high pressure liquid refrigerant is transferred via a line 50 to the evaporator 40 as metered by the expansion device 37. The evaporator 40 is also a heat exchanger. The high pressure liquid refrigerant expands and changes to a gas inside the evaporator 40. This change of state results in a chilling effect that cools fluid from the air conditioned space that enters and exits the evaporator 40 through line 51. It is the fluid, typically air or water, that is cooled in the evaporator 40 to provide the cooling effect in the air conditioned space. After cooling the fluid, the refrigerant suction gas is transported via a line 53 to the inlet port 30 of the screw compressor 10, completing the basic refrigeration loop.

As previously indicated, an air conditioning system that utilizes the compressor 10 also necessarily utilizes large quantities of lubricating oil. In addition to lubricating the bearings 22 and the oil seal 27, the oil is utilized to seal the spaces between the lobes 26, 28 of the rotors 16, 18, respectively and to cool the compressor 10. This necessitates that the oil be injected directly into the inner housing 14 of the compressor 10. Consequently, the lubricating oil and the high pressure refrigerant become thoroughly mixed within the compressor 10.

The oil supply loop commences with the mixed oil and pressurized refrigerant being discharged from the compressor 10 through a common line 38 from the compressor 10 to the oil/gas separator 34. After separation of the oil and the refrigerant as indicated above, the oil collects in the lower reservoir 42 of the oil/gas separator 34. The common line 38 and the oil/gas separator 34 are common to both the refrigeration loop and the oil supply loop. The refrigeration loop and the oil supply loop separate at the oil/gas separator 34.

In the oil/gas separator 34, the heavier oil collects in the lower reservoir 42 of the oil/gas separator 34. The oil flows from the reservoir 42 through a line 52 to an oil cooler 54. The oil cooler 54 is a heat exchanger having its own cooling medium provided through lines 57. Typically this is accomplished by integrating the oil cooler 54 with the condenser 36, although these devices can also be distinct as is shown for clarity's sake in FIG. 2. In the oil cooler 54, the oil gives up a portion of the heat imparted to the oil by the compressor 10. The heat is transferred to the cooling medium in the oil cooler 54. The cooling capacity of the oil cooler 54 is carefully matched to the needs of the compressor 10, such that the oil arrives back at the compressor 10 cooled at least to a specified temperature. This temperature is selected to ensure that the oil is able to provide adequate cooling of the compressor 10 and to ensure that the oil is at a temperature at which the lubricating properties of the oil are optimum. The cooled oil exits the oil cooler 54 via a line 56, passes through a filter 60 and ultimately via a line 62 back to the compressor 10.

The keys to the present invention's detection method are that, (1) in the event of an oil charge loss, the reservoir 42 and the oil cooler 54 quickly fill with refrigerant and (2) the heat transfer coefficient of the refrigerant is different from the heat transfer coefficient of the oil.

The refrigerant entering the oil cooler 54 in the event of an oil loss condition is at the same temperature that the oil should be at because the oil and the refrigerant have the same temperature leaving the compressor 10. However, the oil cooler 54 cools the saturated refrigerant to a greater extent than the oil cooler 54 cools the lubricating oil. Consequently, the temperature of saturated refrigerant as sensed by a temperature sensor $T_2$ at the point of entrance to the compressor 10 will differ from the temperature of lubricating oil as sensed by the sensor $T_2$.

In other words, the heat transfer coefficient of the refrigerant is greater than the heat transfer coefficient of the oil. With respect to a cooling situation as distinct from a heating situation, the heat transfer coefficient of a liquid is a measure of the amount of heat that the liquid will give up when exposed to a particular cooling environment. A liquid that has a high heat transfer coefficient will give up more heat than a liquid with a lower heat transfer coefficient. What this means in the stated preferred embodiment is that in a given cooling environment, such as the oil cooler 54, the refrigerant will give up more of its heat and will exit the oil cooler at a lower temperature than an equal quantity of oil when the oil is cooled in the oil cooler 54. Accordingly, under identical cooling conditions, the refrigerant cooled in the oil cooler 54 will exit the oil cooler 54 at a lower temperature than the oil cooled in the same oil cooler 54.

Two temperatures are sensed at two respective locations, $T_1$ and $T_2$, in order to make a determination that there has been an oil charge loss. A first temperature sensor $T_1$ is preferably located in the condenser 36 and measures the saturated condition temperature of the liquid refrigerant in the condenser 36. As described for example in connection with FIG. 3, the first temperature sensor $T_1$ may also be located elsewhere as long as the temperature measured is representative of the saturated refrigerant temperature. A second temperature sensor $T_2$ measures the temperature of the liquid in the line 62 as the liquid enters the compressor 10. The second temperature may also be located elsewhere such as in the oil cooler 54. This second temperature is indicative of the temperature of the liquid that is currently being cooled in the oil cooler 54. Under normal operating conditions, the liquid cooling in the oil cooler 54 and entering the compressor 10 is oil. Under abnormal operating conditions of an oil charge loss, the liquid cooling in the oil cooler 54 and entering the compressor 10 is refrigerant. This is the case since, as previously indicated, in the event of an oil charge loss, the oil cooler 54 quickly fills with refrigerant. The refrigerant then undergoes the cooling imparted by the oil cooler 54 and is then pumped to the compressor 10.

In the preferred embodiment, the oil cooler 54 is sized such that oil exiting the oil cooler 54 and sensed by the sensor $T_2$ is always three to five degrees Fahrenheit greater than the saturation temperature of the refrigerant sensed at the sensor $T_1$. This defines the normal operating condition with a full oil charge in the oil circulating system. The temperature differential holds true when the air conditioning system is being operated at full capacity and at reduced capacity. It is understood that other temperature differentials are possible as a function of design of the air conditioning system, as a function of the type of compressor involved, and with the use of different refrigerants and oils that have different coefficients of heat transfer. For the proper functioning of the present invention it is important only to know what the temperature differential is under normal operating conditions between the liquid refrigerant in the condenser 36 and the oil in the oil cooler 54.

When there is an oil charge loss condition, liquid refrigerant gathers in the reservoir 42 of the oil/gas separator 34 in place of the lost oil. The refrigerant flows through the line 52 to the oil cooler 54. Since the heat transfer coefficient of the liquid refrigerant is greater than the heat transfer coefficient of the displaced oil, the liquid refrigerant that passes through the oil cooler 54 will give up more of its heat and exit the oil cooler 54 at a lower temperature than an equal quantity of oil would be at when the cooled oil exits the oil cooler 54. Accordingly, the sensor $T_2$ will detect a lower temperature when refrigerant is being cooled and returned to the compressor 10 than when oil is being cooled returned to the compressor 10. In the preferred embodiment, the cooled refrigerant sensed at the sensor $T_2$ will be approximately four degrees Fahrenheit less than the saturated temperature condition refrigerant that is sensed by the sensor $T_1$. The present invention's oil loss detection method depends upon the difference in the temperatures sensed resulting from liquid refrigerant being cooled in the oil cooler 54 as opposed to oil being cooled in the oil cooler 54. Thus, if oil flow is restricted, the oil is cooled to a lower temperature than normal and also results in temperature comparisons outside the normal operating range.

Accordingly, the oil loss detection apparatus and method contained within a controller 68 continually monitors and compares the temperature at the sensor $T_1$ with temperature at the sensor $T_2$. Signals generated by the sensors $T_1$, $T_2$ are sent to the controller 68 via data transmission lines 70. Regardless of the operating condition of the air conditioning system, whether the air conditioning system is operating at full capacity and the saturated temperature in the condenser 36 is elevated or whether it is operating at a reduced capacity and the temperature in the condenser 36 is reduced, the temperature of the refrigerant sensed at the sensor $T_1$ is always three to five degrees Fahrenheit lower than the temperature of the cooled oil sensed at the sensor $T_2$. Similarly, without respect to the current operating capacity of the air conditioning system, e.g. whether the air conditioning system is operating at full capacity or at reduced capacity, the temperature sensed at the sensor $T_1$ will always be higher than the temperature sensed at the sensor $T_2$ during conditions of an oil charge loss because the refrigerant gives up more of its heat than oil would and emerges from the oil cooler 54 cooler that the oil would.

Figure 3:
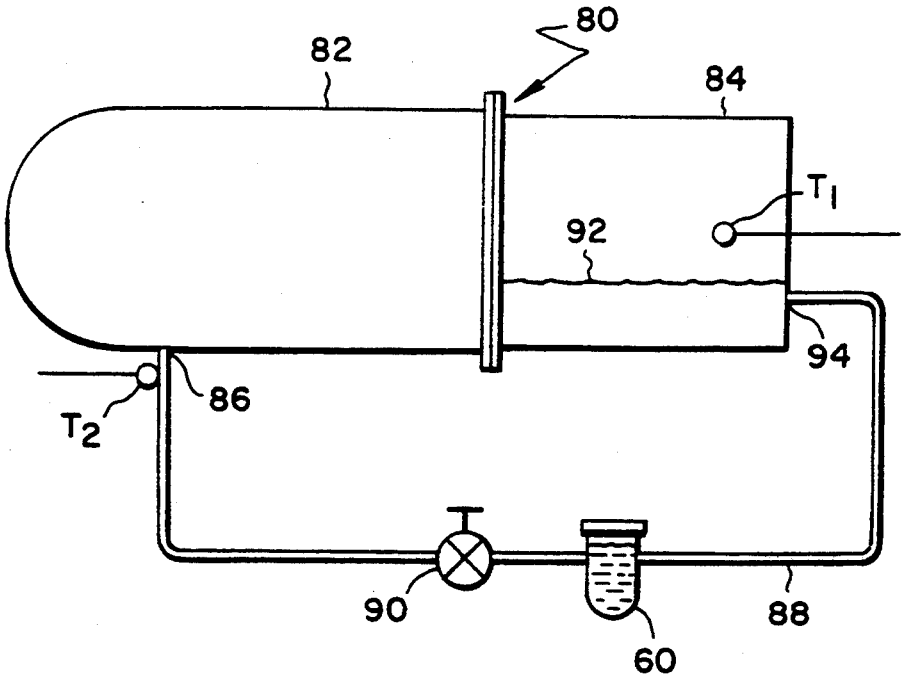
FIG. 3 shows an alternate embodiment of the present invention as shown in FIG. 2.

FIG. 3 is an alternative embodiment of the present invention in which like reference numerals are used for like elements as in the preferred embodiment discussed above in connection with FIG. 2. In FIG. 3 a combined compressor and oil separator tank 80 is shown which includes a compressor portion 82 and an oil separator portion 84. A temperature sensor $T_1$ is provided in the oil separation tank 84 to measure the refrigerant temperature. A temperature sensor $T_2$ is provided at an oil injection port 86 of the compressor portion 82. A line 88 including a filter drier 60 and a solenoid valve 90 supplies a lubricant mixture taken from the bottom of the oil separator tank 84 to the oil injection port 86. A loss of lubricant results in gas passing through line 88 and components in line 88 causing a pressure drop in the refrigerant which reduces the temperature. Similarly to the previous embodiment, this can be detected by comparing $T_2$ and $T_1$. Thus should the level of oil 92 in the oil separator tank 84 drop below the exit port 94 of the oil separator tank, refrigerant instead of oil will pass through the line 88. The temperature change resulting from the pressure drop in the line 88 will create a significant temperature differential between the temperature sensors $T_1$ and $T_2$ which will cause the compressor portion 82 to be shut down by the controller 68 in a manner as described above.

If neither oil or refrigerant flows through the line 88, then $T_2$ becomes suction temperature which is much less than $T_1$ and the appropriate action be taken.

For all operating conditions, comparison of the temperature sensed at the sensor $T_1$ and the temperature sensed at the sensor $T_2$ provides a reliable indication of oil loss detection. The relationship of the temperature sensed at the sensor $T_1$ to the temperature sensed at the sensor $T_2$ causes the generation of a signal to either shut down through the compressor 10 or take any available steps to alleviate the oil loss condition. This detection method is suitably sensitive to generate a shut down signal within the two to three minutes of time that is available between the time of loss of cooling oil charge and the time extensive damage due to loss of lubrication in the screw compressor 10 could occur. The shut down signal is generated within the controller 68 and provided to the compressor 10 via a data transmission line 72.

Essentially, if the temperature differential between the first and second temperatures $T_1$, $T_2$ deviates from a first predetermined temperature differential by a significant amount, such as 1° F. or 2° F., compressor operation will be terminated. Additional protection can be provided by implementing a second predetermined temperature differential which is closer to the operating temperature differential that the first predetermined temperature differential. Whenever this second predetermined temperature differential is violated, the controller 68 begins to accumulate the length of time than the violated condition continues to exist. If the length of time lasts longer than a predetermined amount of time, such as an hour, compressor operation can be terminated or an early warning of an impending loss of lubrication can be transmitted to an operator. Accumulating length of time the violated condition continues to exist can be accomplished by integrating the oil temperature differential over time and terminating compressor operation if the integrated oil temperature differential violates a predetermined limit.

Figure 4:
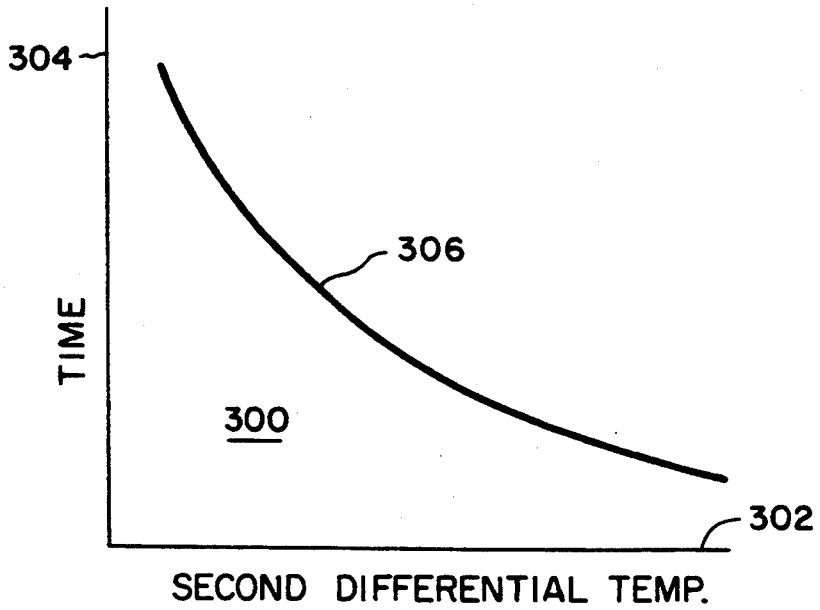
FIG. 4 is an over temperature protection graph of an aspect of the present invention.

The over temperature protection as shown in FIG. 4 represents a graph 300 of the second differential temperature over time which provides compressor over temperature protection. The second differential temperature is represented by the line 302, while the time at any particular temperature differential is represented by the line 304. The second differential temperature is monitored to ensure that it is below a line 306 representing an operating time temperature limit. The controller 68 will shut down the system if the second differential temperature is excessive, i.e. passes the limit represented by the line 306, for a given time period. Thus, the compressor 10 is protected from both rapid and gradual increases in oil temperature resulting from an oil loss as defined herein.

The present invention also protects from oil loss more truly described as inadequate or over adequate cooling in the oil cooler 54. As previously noted, the condenser 36 and the oil cooler 54 are usually unitary. Therefore if the condenser fan (not shown) fails, the oil passing through the oil cooler 54 will not be cooled. The hot oil will not complete its secondary function of cooling the compressor 10. However, the present inventions comparison of $T_1$ and $T_2$ will also detect the deviation in the expected temperature differential and act to protect the compressor 10.

A second situation addresses a blockage in the line 56 caused, for example, by a clogged filter 60 or a malfunction valve. The oil filter 54 will fill up with oil and, if the temperature sensor $T_2$ were located in the oil cooler 54, potentially not indicate an oil loss. However, the oil flow through the oil cooler 54 is not at optimum efficiency. Consequently, more cooling of oil results with more oil flow. The flooded oil cooler 54 will be cooled more than normal and will be detected by a comparison of $T_2$ and $T_1$ in accordance with the present invention.

Various changes in configuration and components and modifications in practice may be introduced to the foregoing without departing from the invention. Specifically, the screw compressor 10 may be replaced by a centrifugal compressor, a scroll compressor, a reciprocating compressor or the like. Representative compressors are shown in U.S. Pat. Nos. 5,212,964; 4,730,988 and 3,805,847, are assigned to the assignee of the present invention, and are incorporated herein by reference. Additionally, the sensor $T_2$ may be located at the point of injection into the compressor, in the oil cooler, or in the oil lines. The sensor $T_1$ is preferably located in the condenser but may also be located in the oil separator or the refrigerant line connecting the condenser and the oil separator. Thus the particularly shown and discussed preferred embodiments are intended in an illustrative and not in a limiting sense. The true spirit and scope of the invention is set forth in the following claims.

What is claimed is:

1. A method of compressor over temperature protection comprising the steps of:

monitoring the temperature of oil entering and exiting a compressor;

determining an oil temperature differential between the entering and exiting oil temperatures;

comparing the oil temperature differential to first and second predetermined limits;

terminating compressor operation if the first limit is exceeded by the oil temperature differential; and terminating compressor operation if the second temperature limit is exceeded by the oil temperature differential for longer than a first time period.

2. The method of claim 1 including the further step of setting the length of the first time period in direct proportion to the proximity of the oil temperature differential to the first predetermined limit.

3. A method of compressor temperature protection comprising the steps of:

monitoring the temperature of oil entering and exiting the compressor;

determining an oil temperature differential between the entering and exiting oil temperatures;

integrating the oil temperature differential over time;

comparing the integrated oil temperature differential to a predetermined limit; and terminating compressor operation if the integrated oil temperature differential exceeds the predetermined limit.

* * * * *

UNITED STATES PATENT AND TRADEMARK OFFICE

CERTIFICATE OF CORRECTION

PATENT NO. : 5,431,025

DATED : July 11, 1995

INVENTOR(S) : Robert L. Oltman and Michael D. Carey

It is certified that error appears in the above-identified patent and that said Letters Patent is hereby corrected as shown below:

On the title page item [75],

Delete "Robert L. Oltman"

Signed and Sealed this

Thirty-first Day of October 1995

*Attest:*

*Attesting Officer*

BRUCE LEHMAN

*Commissioner of Patents and Trademarks*